US010648274B2

(12) United States Patent
Hughes et al.

(10) Patent No.: US 10,648,274 B2
(45) Date of Patent: May 12, 2020

(54) APPARATUS AND METHOD FOR OPENING AND CLOSING IN MULTIPLE CYCLES A DOWNHOLE SLEEVE USING AN INTERVENTION TOOL

(71) Applicant: The WellBoss Company, Inc., Alberta OT (CA)

(72) Inventors: John Hughes, Calgary (CA); James W. Schmidt, Calgary (CA); Shane D'Arcy, Calgary (CA)

(73) Assignee: The WellBoss Company, Inc. (CA)

( * ) Notice: Subject to any disclaimer, the term of this patent is extended or adjusted under 35 U.S.C. 154(b) by 50 days.

(21) Appl. No.: 15/697,792

(22) Filed: Sep. 7, 2017

(65) Prior Publication Data

US 2018/0238137 A1 Aug. 23, 2018

Related U.S. Application Data

(60) Provisional application No. 62/460,483, filed on Feb. 17, 2017.

(51) Int. Cl.

| | |
|---|---|
| ***E21B 33/128*** | (2006.01) |
| ***E21B 34/14*** | (2006.01) |
| ***E21B 23/00*** | (2006.01) |
| ***E21B 23/06*** | (2006.01) |
| *E21B 34/00* | (2006.01) |
| *E21B 43/114* | (2006.01) |
| *E21B 43/26* | (2006.01) |

(52) U.S. Cl.
CPC ..... *E21B 33/1285* (2013.01); *E21B 23/006* (2013.01); *E21B 23/06* (2013.01); *E21B 34/14* (2013.01); *E21B 43/114* (2013.01); *E21B 43/26* (2013.01); *E21B 2034/007* (2013.01)

(58) Field of Classification Search
CPC combination set(s) only.
See application file for complete search history.

(56) References Cited

U.S. PATENT DOCUMENTS

| | | | | |
|---|---|---|---|---|
| 9,097,079 | B2 | 8/2015 | Themig | |
| 2008/0230233 | A1* | 9/2008 | Fay | E21B 23/01 166/382 |

(Continued)

*Primary Examiner* — Cathleen R Hutchins
*Assistant Examiner* — Ronald R Runyan
(74) *Attorney, Agent, or Firm* — Rao DeBoer Osterrieder, PLLC; John M. DeBoer

(57) ABSTRACT

A downhole wellbore system is provided, comprising one or more downhole sleeves run on a liner; and an intervention tool deployable into the liner. The intervention tool is reciprocateable within the line and one or more downhole sleeves between any one or more positions selected from the group consisting of: downhole sleeve opening position, downhole sleeve closing position, pull uphole position, push downhole position, and setting in a blank section of the liner position. A method is further provided for manipulating an intervention tool in a liner comprising one or more downhole sleeves. The method comprises the steps of deploying an intervention tool into the liner and reciprocating the intervention tool between one or more positions selected from the group consisting of: downhole sleeve opening position, downhole sleeve closing position, pull uphole position, push downhole position, and setting in a blank section of the liner position.

25 Claims, 10 Drawing Sheets

(56) References Cited

U.S. PATENT DOCUMENTS

| | | | | |
|---|---|---|---|---|
| 2011/0308817 | A1* | 12/2011 | Ravensbergen | E21B 34/102 166/382 |
| 2013/0319658 | A1* | 12/2013 | Huh | E21B 33/13 166/250.01 |
| 2016/0298404 | A1 | 10/2016 | Beckett et al. | |

* cited by examiner

APPARATUS AND METHOD FOR OPENING AND CLOSING IN MULTIPLE CYCLES A DOWNHOLE SLEEVE USING AN INTERVENTION TOOL

FIELD OF THE INVENTION

The present invention relates to devices and methods for opening and closing in multiple cycles a downhole sleeve using a bottom hole assembly or intervention tool.

BACKGROUND OF THE INVENTION

Downhole oil and gas production operations, and particularly those in multi-stage horizontal wells, require the stimulation and production of one or more zones of a hydrocarbon bearing formation. In many cases this is done by running a liner or casing string downhole, in which the liner or casing string comprises one or more downhole sleeves, including but not limited to ported sleeves or collars, at spaced intervals along the wellbore. The location of the downhole sleeves is commonly set to align with the formation zones to be stimulated or produced. The sleeves must be manipulated in order to be opened or closed as required. In some instances, this is achieved by running a bottom hole assembly, also known as an intervention tool, down through the liner or casing string, locating in the downhole sleeve to be manipulated and manipulating the sleeve by any number of means including use of mechanical force on the intervention tool, or by hydraulic pressure.

The bottom hole assembly (BHA), or intervention tool, also known by any number of other names, is typically run on a tubing string that can be coil tubing or other tubing. The intervention tool is sent down inside the liner or casing string for the purposes of locating inside and interacting with the downhole sleeve adjacent the formation zone to be treated or produced. Once located near or inside the downhole sleeve, the intervention tool typically engages against the downhole sleeve or against the liner or casing near the downhole sleeve, and then the intervention tool is either mechanically manipulated or hydraulic pressure is used to manipulate the downhole sleeve as required to stimulate the oil-bearing formation, or to produce hydrocarbons from the formation. After treatment, it may also be desirable to again manipulate the downhole sleeve. In many cases, it is also desirable to set an intervention tool in a liner or casing string or a blank pipe.

Once opened, in many cases, it is desirable to be able to further manipulate the intervention tool within the liner after opening the downhole sleeve, to then be able to re-close the downhole sleeve. It is further desirable to be able to return the intervention tool to the initial run in hole position, for ease of running the intervention tool further down the wellbore, or to pull the intervention tool out of the hole, without having the downhole sleeve unintentionally open or close. In some cases, a downhole sleeve might become stuck and not mechanically openable, in which case it may be necessary to move the intervention tool further downhole and position a perforator run on the intervention tool to perforate the liner proximal to the downhole sleeve. In other cases, it may be desirable to move the intervention tool uphole and down hole through the liner to check locations of downhole sleeves, or to open or close downhole sleeves in a non-sequential manner.

There is therefore still a need for intervention tool and sleeve systems that can run an intervention tool inside a downhole tool or inside a liner or casing string to open the downhole sleeve or set in the liner or casing, and for systems that allow for multiple positions of the intervention tool within the liner for varying purposes.

SUMMARY

A downhole wellbore system is provided, comprising one or more downhole sleeves run on a liner; and an intervention tool deployable into the liner and into any one of said one or more downhole sleeves, said intervention tool comprising one or more slips, a packer and a collet selectively engagable in the inner surface of the downhole sleeve. The intervention tool is reciprocateable within the liner and one or more downhole sleeves between any one or more positions selected from the group consisting of: downhole sleeve opening position, downhole sleeve closing position, pull uphole position, push downhole position, and setting in a blank section of the liner position, which is the same as the sleeve opening position.

A method is further provided for manipulating an intervention tool in a liner comprising one or more downhole sleeves. The method comprises the steps of deploying an intervention tool into the liner and into any one of said one or more downhole sleeves, said intervention tool comprising one or more slips, a packer and a collet selectively engagable in the inner surface of the downhole sleeve; and reciprocating the intervention tool between one or more positions selected from the group consisting of: downhole sleeve opening position, downhole sleeve closing position, pull uphole position, push downhole position, and setting in a blank section of the liner position.

BRIEF DESCRIPTION OF THE DRAWINGS

A further, detailed, description of the invention, briefly described above, will follow by reference to the following drawings of specific embodiments of the invention. The drawings depict only typical embodiments of the invention and are therefore not to be considered limiting of its scope. In the drawings.

Figure 1A:
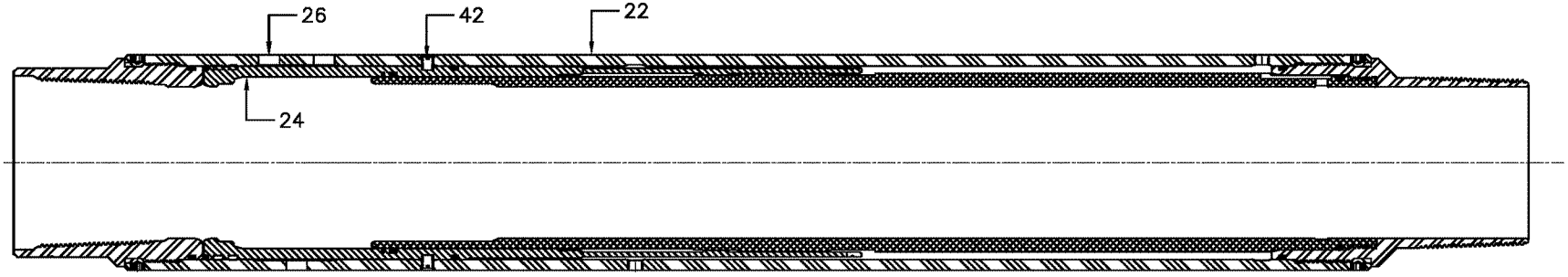
FIGS. 1*a* and 1*b* are cross sectional views of one embodiment of a downhole sleeve of the present invention, in a closed and an open position respectively.
Figure 1B:
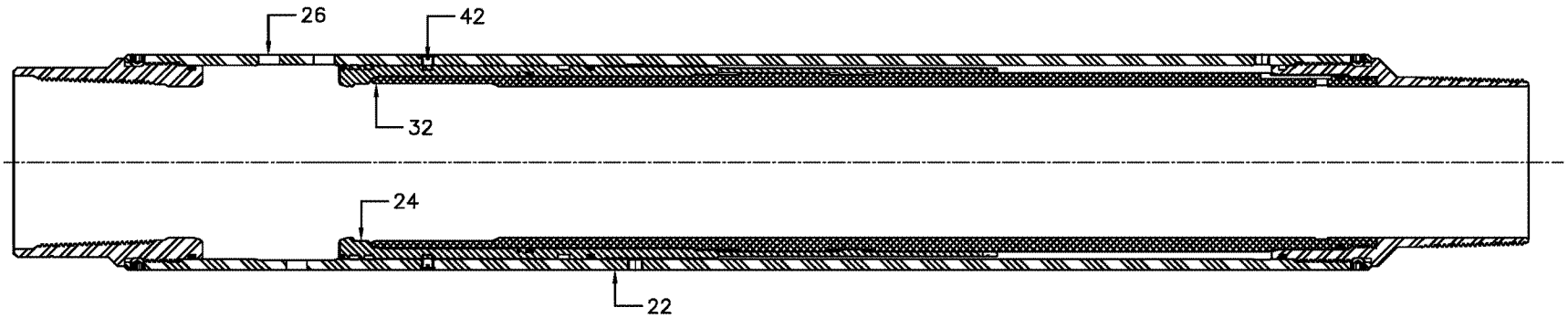
Figure 2A:
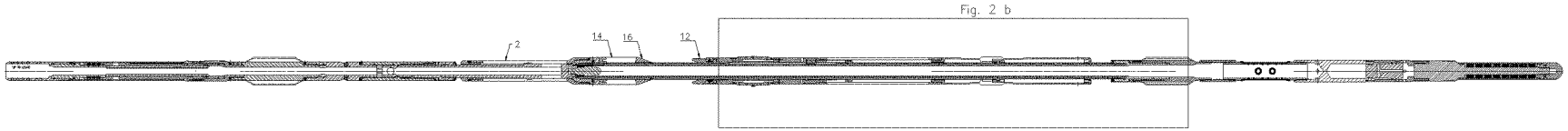
FIG. 2*a* is a cross sectional view of one embodiment of an intervention tool of the present invention, including uphole and downhole auxiliary tools.
Figure 2B:
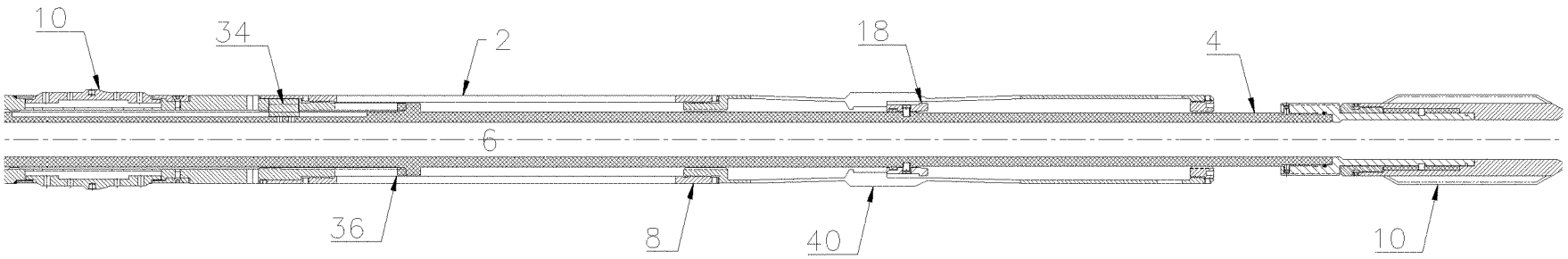
FIG. 2*b* is a detailed cross sectional view of the intervention tool of FIG. 2*a;*

The drawing is not necessarily to scale and in some instances proportions may have been exaggerated in order more clearly to depict certain features.

DETAILED DESCRIPTION OF VARIOUS EMBODIMENTS

The description that follows and the embodiments described therein are provided by way of illustration of an example, or examples, of particular embodiments of the principles of various aspects of the present invention. These examples are provided for the purposes of explanation, and not of limitation, of those principles and of the invention in its various aspects.

The present invention provides a device for setting an intervention tool in a downhole sleeve and opening the downhole sleeve. The present invention further provides a means of maneuvering the intervention tool within a downhole sleeve to manipulate the downhole sleeve through a number of stages of operation. The present intervention tool is also capable of setting in a blank section of liner or casing, using the same steps as for setting in downhole sleeve.

The present invention more specifically provides at least one downhole sleeve and an intervention tool, having slips and packers, that can be run into the downhole sleeve.

The slips can be set and the packer packed off against an inner surface of the downhole sleeve, to thereby isolate a section of the liner or casing on which the downhole sleeve is run. Once the downhole sleeve is isolated, a valve of the downhole sleeve can be opened by hydraulic pressure, and the formation can be fractured through the opened sleeve.

To close the valve of the downhole sleeve, the intervention tool can actively engage the downhole sleeve in a specific position by pulling the intervention tool uphole. More specifically, to close the valve, the intervention tool more particularly has a collet that can engage in a unique profile in the downhole sleeve, such that axial movement of the intervention tool will mechanically manipulate the downhole sleeve valve to close it after opening. Preferably, this is the only position in which the collet actively engages any surface of the downhole tool.

Although some embodiments of the present intervention tool are described and illustrated in the context of use with a ported sleeve, it would be well understood by a person of skill in the art that the present intervention tool could be used with any number of types of downhole tools that require activation of some kind, including downhole tools used in straddle perforation applications, any downhole tool in which a packer is required to set to create a pressure differential, or any downhole tool in which manipulation of the downhole tool requires that a profile on the downhole tool be engaged and mechanically manipulated. And the present intervention tool can be shifted from engaging a downhole sleeve, to setting inside a section of blank liner or casing, wherein said shifting from one to other is accomplished merely by axial movement of the present tool.

With reference to FIGS. 1*a*, 1*b*, 3*a* and 3*b*, one embodiment of a downhole sleeve 22 is shown having a valve 24 that is moveable to close and open one or more ports 26. When the valve 24 in in the open position, the port 26 is open and fluid can flow from an inner bore 6 of a mandrel 4 of an intervention tool 2, and out through the port 26 to the formation beyond. Or fluid can flow from an annulus 28 between the intervention tool 2 and an inner surface of the downhole sleeve 22 through the port 26 and out to the formation to be treated or stimulated. While the present figures depicts the valve 24 of the downhole sleeve 22 as being an inner valve at least partially sandwiched between an outer and inner layer of the downhole tool 22, it would be well understood by a person of skill in the art that an exposed valve would be just as effective and is covered in the scope of the present application.

With reference to FIGS. 2*a*, 2*b* and 3-9 which illustrate one embodiment of an intervention tool 2 of the present invention, the intervention tool 2 comprises a mandrel section 4 having an outer surface and a continuous axial inner bore 6. The mandrel 4 is preferably at least partially radially surrounded by a drag assembly 8 that is slidably arranged over the mandrel 4 outer surfaces. The drag assembly 8 houses a locator mechanism 10 and a set of one or more slips 12. In a preferred embodiment, the mandrel 4 is both axially and rotatably moveable vis a vis the drag assembly 8.

With reference to FIGS. 3*c*, 4*c*, 7*b*, 8*b* and 9*b*, in a further preferred embodiment, a J-pin and J-slot arrangement 30 between the mandrel 4 and drag assembly 8 can guide movement of the mandrel 4 relative to the drag assembly 8 and ensures that the mandrel 4 position is held until a further compressive or tensile force is applied to move the mandrel 4 to the next position. By holding various positions between the mandrel 4 and the drag assembly 8, the J-pin and J-slot arrangement 30 ensures that the present intervention tool can be run downhole into a downhole sleeve 22 without inadvertently setting slips 12 or packing elements 14 prior to locating. The arrangement 30 also allows shifting the intervention tool 2 from setting in the downhole sleeve 22 to setting in a section of blank liner or casing by only applying an axial tensile or compressive force and using the same steps as used for setting in a downhole sleeve 22.

The drag assembly 8 further includes one or more resilient collet fingers 40 around the circumference of the drag assembly 8. An outer surface of the collet fingers 40 can engage an inner surface of the downhole sleeve 22. An inner surface of each collet 40 has a profile formed thereon.

The mandrel 4 includes a shear sub 18 that is either integrally part of, or separate to but supported on, the outer surface of the mandrel 4, and arranged around the circumference of the mandrel 4, such that each shear sub 18 aligns circumferentially with a collet 40. The shear sub 18 further has a profile formed on an outer surface thereof, said profile matable with the profile on the inner surface of each collet 40.

A bypass 20 is preferably moveably located within the inner bore 6 of the mandrel 4 and is moveable between a closed position which blocks fluid flow through the inner bore 6 to an open position which allows flow through the inner bore 6.

The shear sub 18 together with the mandrel 4 is moveable and rotatable relative to the collet 40 on the drag assembly 8, such that the shear sub 18 may be able to sit under the collet 40 in engagement therewith, to support the collet 40 and lock it in an extended position. This position, in which the shear sub 18 is under the collet 40 and locks the collet 40 in radially outward position preferably only occurs in one stage of the use of the intervention tool 2, as will be described in more detail below.

The shear sub 18 presents no restriction to the inner bore 6 of the mandrel 4 and allows for full fluid flow through inner bore 6 when the bypass 20 is in the open position. This ensures that the inner bore 6 of the present intervention tool 2 does not get clogged up with sand from the formation, and ensures no flow restrictions.

With reference to the Figures, the intervention tool 2 of the present invention can be used inside a downhole sleeve. The downhole sleeve of the Figures is depicted as a multi-cycle ported sleeve 22, however it would be understood that any number of downhole sleeves 22 can be manipulated by the present invention.

While a downhole sleeve 22 is shown as one example of a downhole tool in which the present intervention tool 2 can be used, it would be well understood by a person of skill in the art that the downhole tool can be a production sleeve in which case, hydrocarbon product can flow from the formation, through the port 26 and through the liner or casing on which the downhole tool is run. Such embodiments are also covered by the scope of the present invention.

The downhole sleeve 22 further comprises a profile 32 on an inner surface of the valve 24, for receiving the collet 40, which can expand radially into profile 32, to positively locate the intervention tool 2 for closing the valve 24, once opened.

In a first step, the intervention tool 2 moves freely downhole in a compression state, in what is called a run in hole position in which the shear sub 18 is distanced from the collet 40 and collet fingers 40 are collapsed. The configuration of the j-slot and j-pin arrangement 30 prevents the cone 16 from contacting the slips 12 and packing element 14 cannot be set at this point. The collet fingers 40 of the drag assembly 8 engages an inner surface of the downhole sleeve 22 and acts as a drag mechanism, holding the drag assembly 8 in place and allows the mandrel 4 to rotatably and axially move relative to the drag assembly 8, preferably with the J-pin and J-slot arrangement 30 guiding this movement, for subsequent operations.

In a next step, the intervention tool 2 is pulled tension and the mandrel 4 and shear sub 18 rotates relative to the collet fingers 40 of the drag assembly 8 and will stroke upwards but only to a set point, still distanced from the collet inner surface profile. This is the final phase before setting the intervention tool 2. In a further step, the intervention tool 2 is pushed into compression and the mandrel 4 and shear sub 18 will rotate inside the drag assembly 8. In this position the shear sub 18 is positioned furthest away from the collet fingers 40. As seen in FIG. 3*c*, the J-pin 34 is in the long stroke of the J-slot 38 and the lugs 36 on the mandrel are displaced away from the drag assembly 8 and towards the collet 40.

Continued compression in this phase moves the cone 16 under the slips 12 and the slips 12 are urged outwards and engage the inner surface of the downhole sleeve 22. Further compression is applied to the intervention tool 2. The slips 12 support the compressive load and do not allow downward movement of the mandrel, thereby packing off the packing element 14 inside the downhole sleeve 22. The sleeve 22 is now no longer pressure balanced. This position is illustrated in FIGS. 3*a* and 3*b*

Figure 3A:
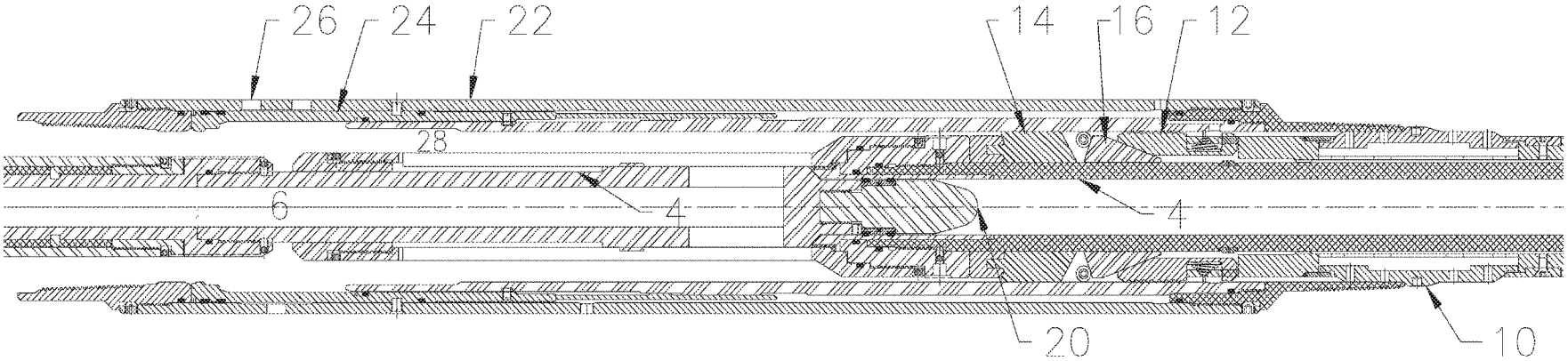
FIGS. 3*a* and 3*b* are cross sectional views of one embodiment of an intervention tool of the present invention within a downhole sleeve of the present invention, in a slip set and packed off position.
Figure 3B:
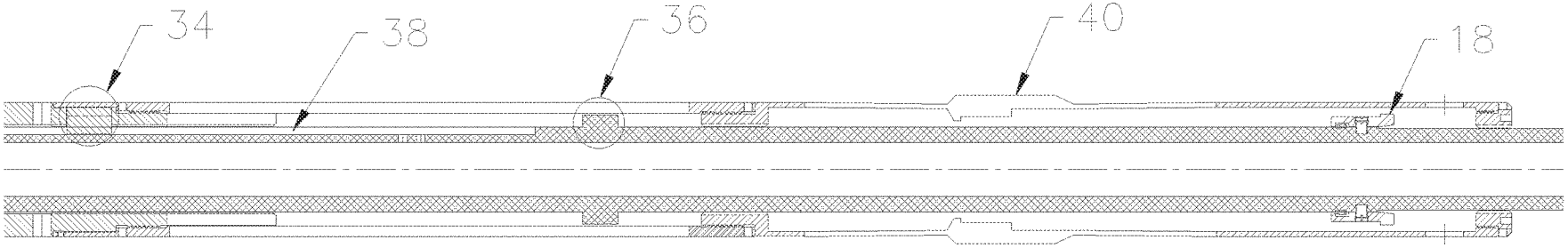
Figure 3C:
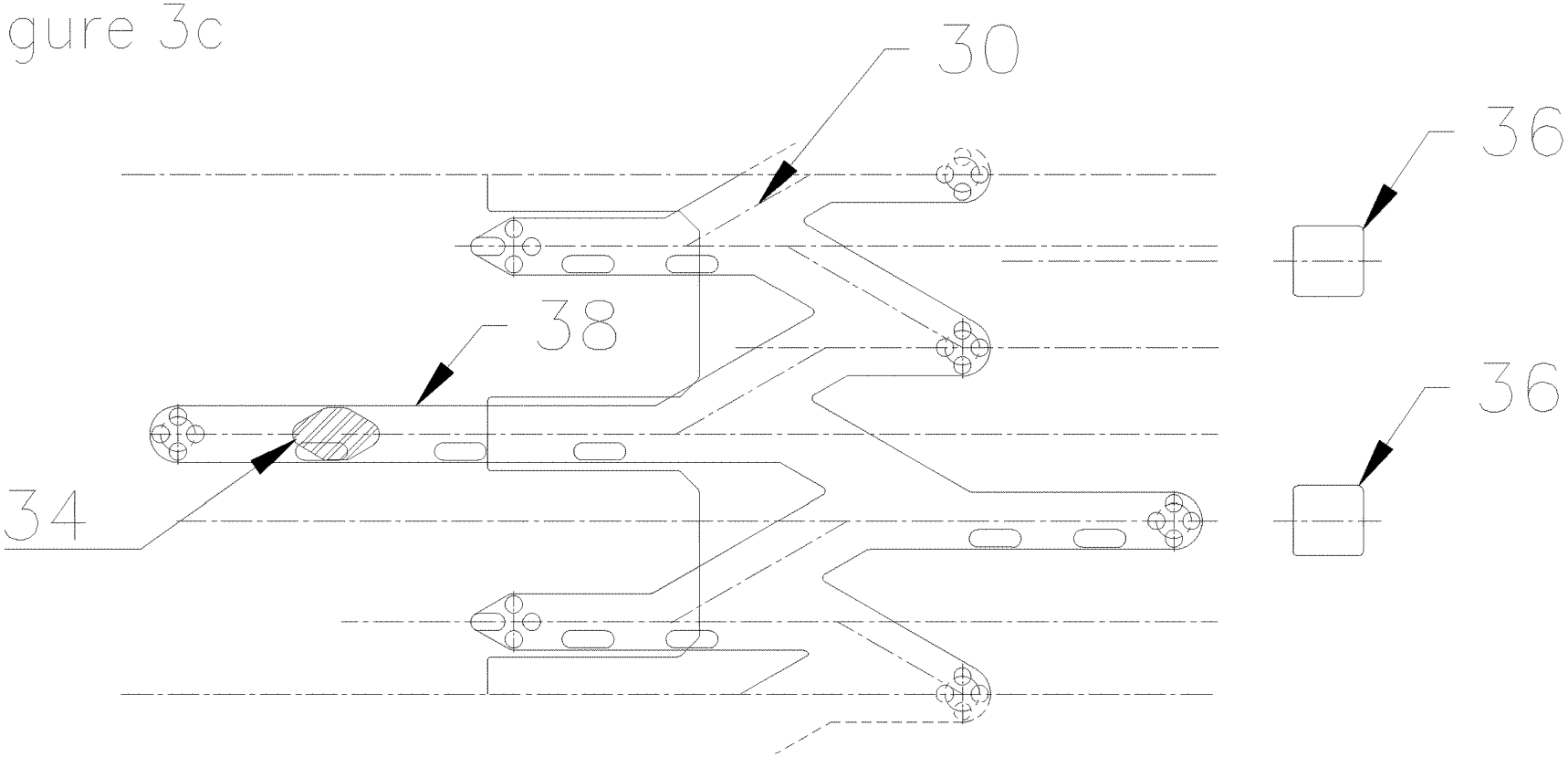
FIG. 3*c* is an elevation view of J-pin and J-slot positions for the configuration of FIGS. 3*a* and 3*b;*

As illustrated in FIGS. 3*a* and 3*b*, once the intervention tool 2 is located and the slips 12 and packing element 14 set, hydraulic pressure can be applied either down the inner bore 6 of the intervention tool 2, or through the annulus 28 between the intervention tool 2 an inner surface of the downhole sleeve 22 to create pressure differential between an uphole end of the valve 24 and a downhole end of the valve 24, the uphole end being isolated from the downhole end by the packing element 14. This pressure differential causes the valve 24 to shift from a closed position to an open position and allows fluid to pass through the port 26 and out to the formation to be treated or stimulated, or alternatively, allows production fluids to travel in from the formation through the port 26 and up to surface. Preferably a shear screw 42 between the valve 24 and an outer layer of the downhole sleeve 22, controls initial opening of the valve 24 at a predetermined hydraulic pressure. The collet 40 is located downstream of the sleeve 22 and the shear sub 18 is distanced from the collet 40 allow the collet 40 to retract. As seen in FIG. 3*c* the j-pin 34 is in the long compression stroke of the j-slot 38 and at a rotation of 0 degrees. The shear sub 18 is away from the collet fingers 40, thus the collet fingers 40 are said to be in "soft collet" mode.

Figure 4A:
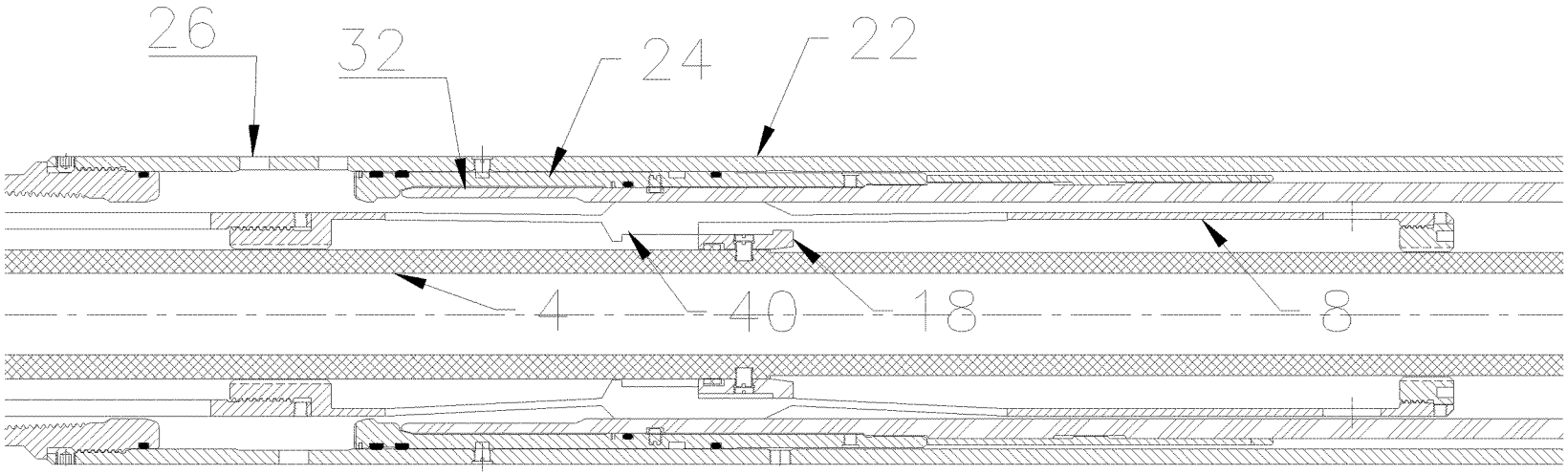
FIGS. 4*a* and 4*b* are progressive cross sectional detailed views of one embodiment of an intervention tool of the present invention in a downhole sleeve of the present invention, showing the intervention tool_just prior to (FIG. 4*a*) and then being (FIG. 4*b*) engaged in a profile of the downhole sleeve and locked into engagement with the profile by a shear sub on the intervention tool.
Figure 4B:
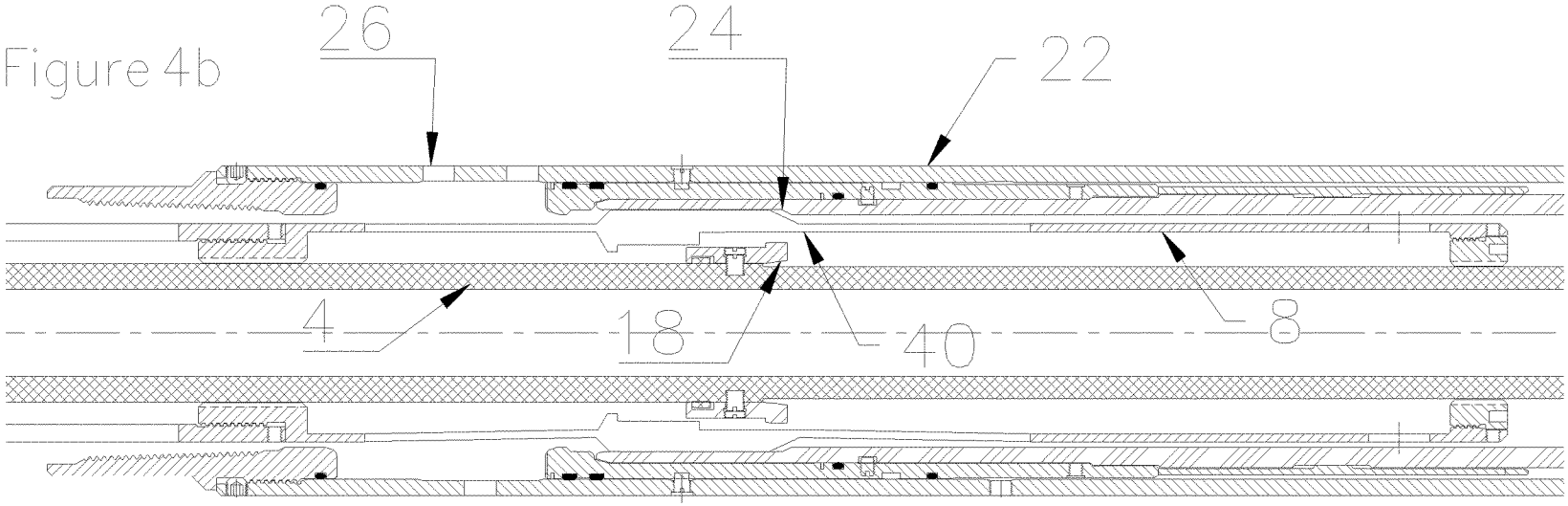
Figure 4C:
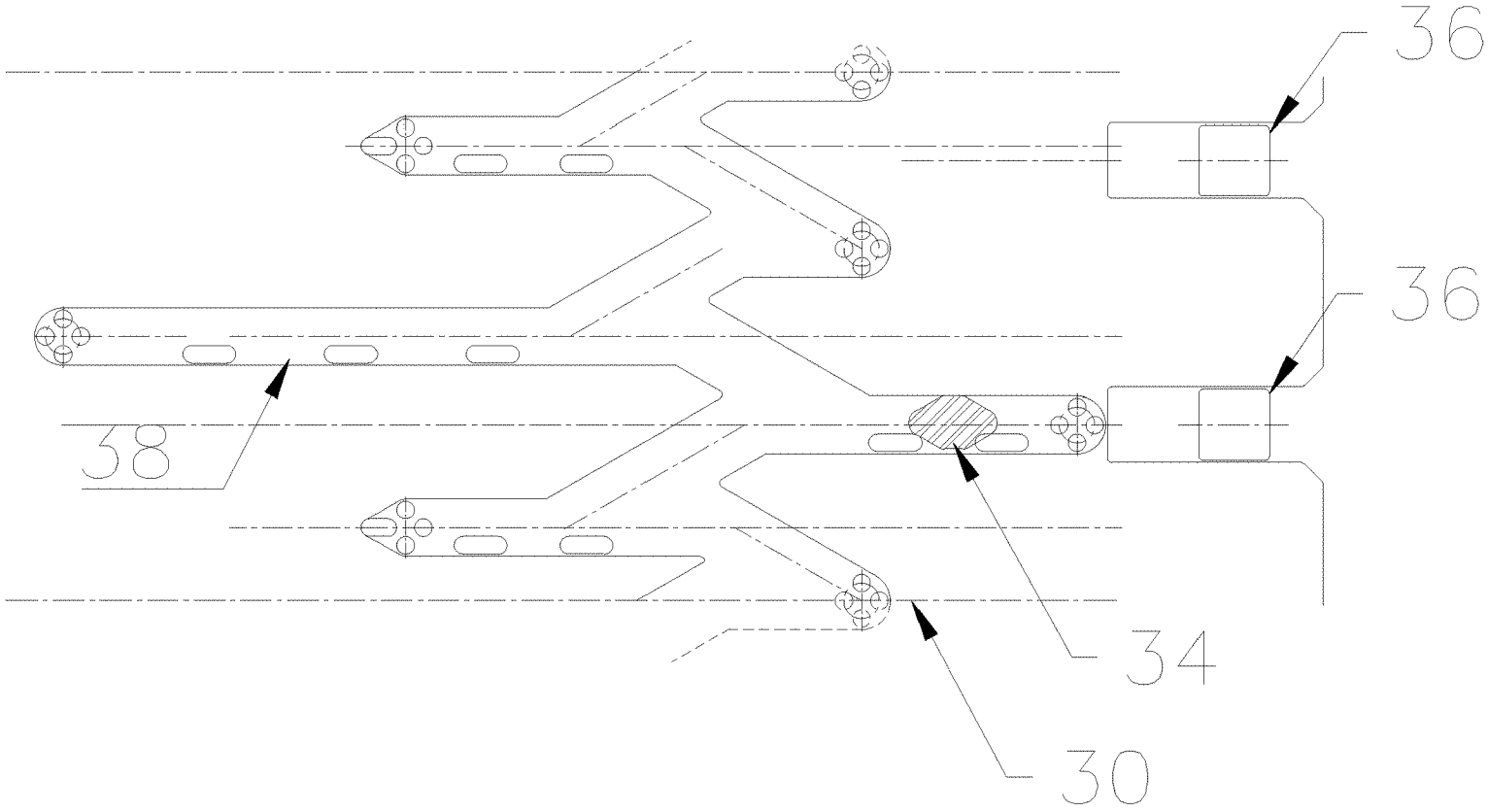
FIG. 4*c* is an elevation view of J-pin and J-slot positions for the configuration of FIG. 4*b;*

After stimulating or production operations are complete it may be desirable to close the valve 24 to prevent further fluid flow between a particular section of the formation and its associate sleeve 22. With reference to FIGS. 4*a*, 4*b* and 4*c*, The intervention tool 2 can be pulled into tension to release the packed off packing element 14 and pull the cone 16 away from the slips 12, thereby releasing engagement of the packing element 14 and slips 12 from the inner surface of either the downhole sleeve 22 or the liner or casing. Design of the J-pin and J-slot arrangement 30 causes the mandrel 4 and shear sub 18 to rotate relative to the collet fingers 40 and the drag assembly 8. In this manner, the shear sub 18 moves into and under the profile of the inner surface of each associated collet finger 40. As the intervention tool 2 is pulled uphole the resilient collet fingers 40 snap up into the profile 32 in the inner surface of valve 24. When the collet fingers 40 snap into the profile 32 space is created on an inner surface of the collet fingers 40 for the shear sub 18 to prop under each collet finger 40, thereby preventing collet fingers 40 from radially displacing. With the collet fingers 40 now radially locked into position by the shear sub 18 under and in engagement with the profile 32 of the vale 24, additional tension at a predetermined value will now exert a mechanical force to pull the valve 24 to the closed position and close the downhole sleeve 22. With reference to FIG. 4*c*, the j-pin 34 is moved into the long tension stroke of the j-slot 38 at a rotation of 60 degrees from the position of FIG. 3*c* and the collet fingers 40 are in "hard collet" mode.

Figure 5:
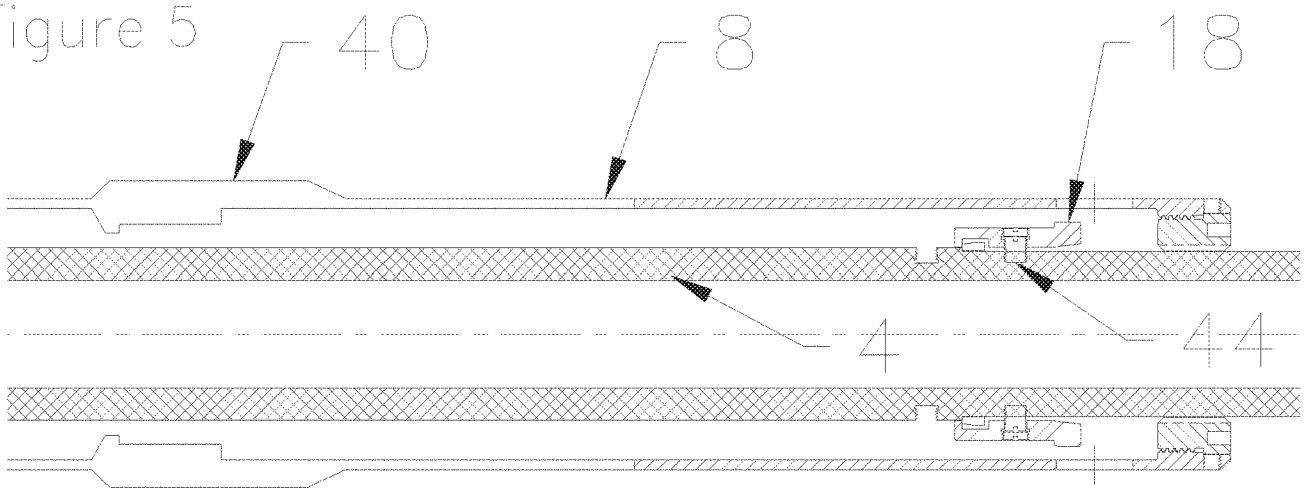
FIG. 5 is a cross sectional detailed view of one embodiment of an intervention tool of the present invention after an emergency shear release force is applied to the mandrel to shear the shear screws of the shear sub to disengage the shear sub from the mandrel.

With reference to FIG. 5, if an emergency situation arises and the downhole sleeve 22 cannot close or is closed and additional means is needed to disengage the collet 40 from the profile 32 in the valve 24, then additional tension, more preferably, almost twice that needed to typically close the sleeve 22, allows a shear screw 44 between the shear sub 18 and the mandrel 4 to shear, thus releasing the shear sub 18 to now move loosely on the mandrel 4. The shear sub 18 now no longer locks the collet fingers 40 into the profile 32 and the collet fingers 40 can be urged radially inwardly so that the collet fingers 40 can no longer lock under or engage the profile 32 in subsequent operations.

Figure 6:
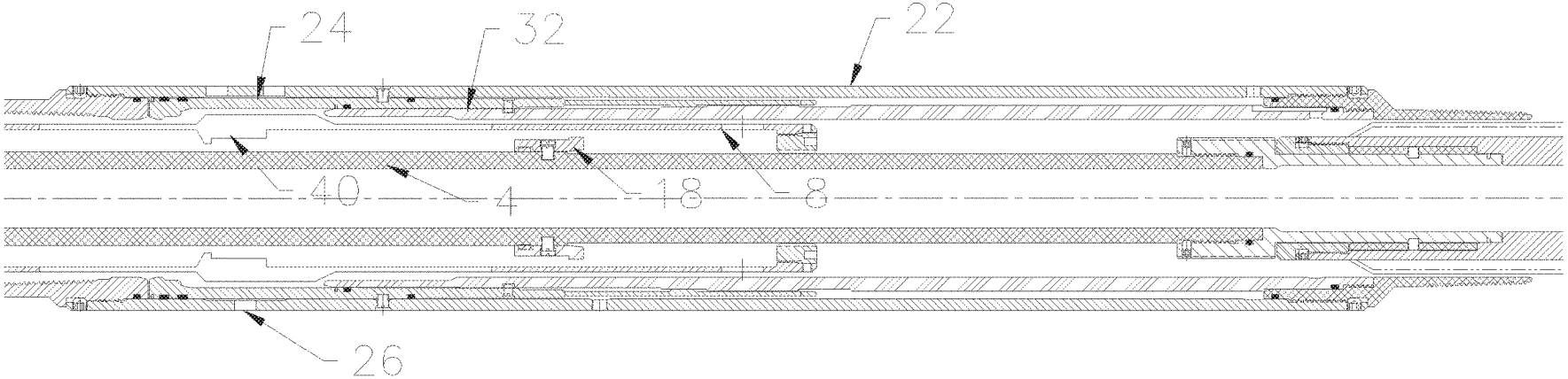
FIG. 6 is a detailed cross sectional view of one embodiment of an intervention tool of the present invention in a downhole sleeve of the present invention, with the collet located in the profile of the downhole sleeve and the shear sub distanced from the collet, to allow the collet the retract.

With reference to FIG. 6, after the valve 24 of downhole sleeve 22 closes, the next step is to push the intervention tool 2 into compression to disengage the shear sub 18 from the collet fingers 40 and in turn, to release engagement of the collet fingers 40 with profile 32. As the tool is pushed into compression, the mandrel 4 and shear sub 18 rotate relative to the collet fingers 40 and the drag assembly 8 so that the shear sub 18 is now displaced away from the collet finger inner surface profile and the collet fingers 40 are again resilient and can be urged radially inwardly to allow the intervention tool 2 to move within the sleeve 22 again. In this position, the j-pin 34 is in compression short stroke of the j-slot 38 and rotated to 130 degrees from the position of FIG. 3*c* and the collet is in "soft collet" mode.

Once relocated, it may be desirable to again move the intervention tool 2 uphole to an uphole sleeve for manipulation, or to confirm locations of uphole sleeves, or to pull the intervention tool 2 out of the hole. In such cases, it is desirable not to re-close any open downhole sleeves 22.

Figure 7A:
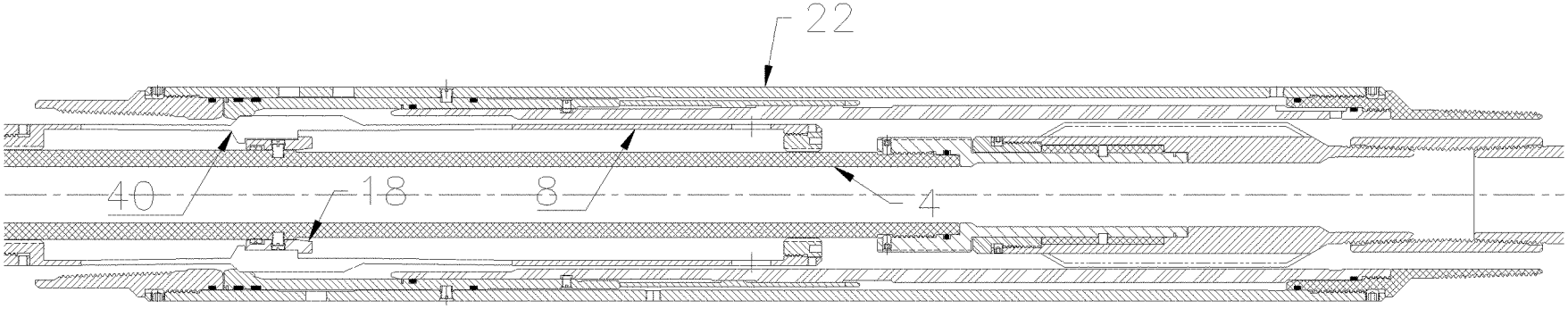
FIG. 7*a* is a detailed cross sectional view of one embodiment of an intervention tool of the present invention in a downhole sleeve of the present invention, with the collet pulled uphole of the downhole sleeve profile and shear sub unengaged with the collet, to allow the collet the retract.
Figure 7B:
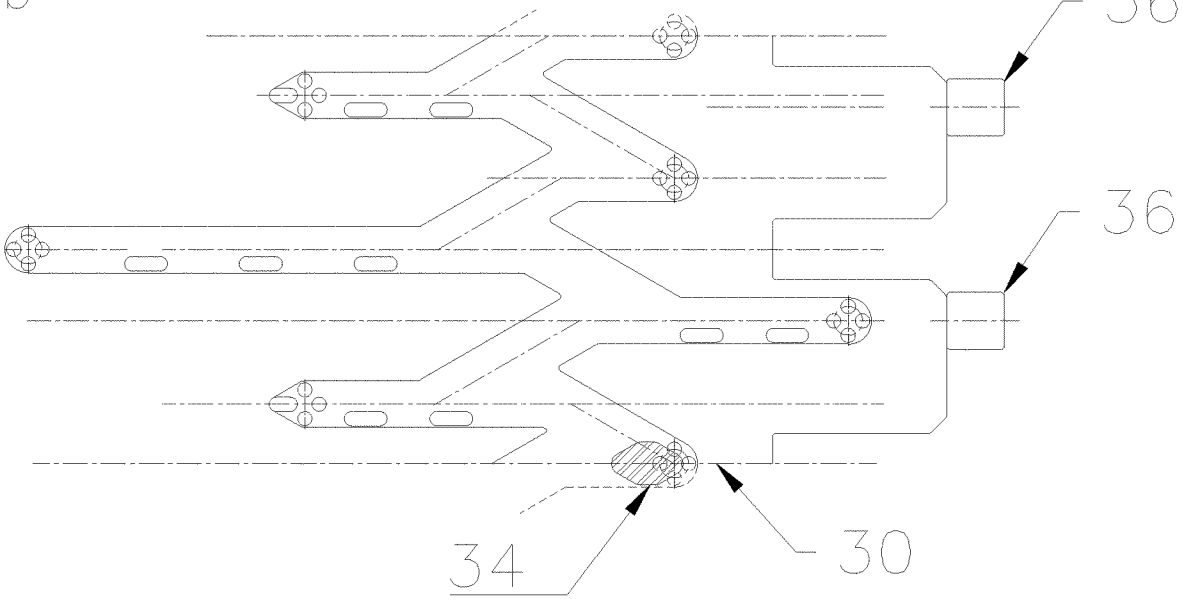
FIG. 7*b* is an elevation view of J-pin and J-slot positions for the configuration of FIG. 7*a;*

In such cases, with reference to FIGS. 7*a* and 7*b*, by pulling intervention tool 2 into tension, the mandrel 4 and shear sub 18 rotates relative to the collet fingers 40 and the drag assembly 8. The shear sub 18 moves closer to collet in moving up but cannot be pulled into the collet profile in this orientation and the collet fingers 40 are again in resilient 'soft mode' and the intervention tool can be moved uphole without closing downhole sleeve 22. With reference to FIG. 7, the j-pin 34 is in the tension short stroke of the j-slot 38 and rotated to 180 degrees from the position of FIG. 3*c* and the collet is in "soft collet" mode.

After having pulled to intervention tool 2 uphole, for example to manipulate or check location of any uphole sleeve tools, it is again possible to run the intervention tool 2 downhole again. Cycling the intervention tool 2 into compression, with reference to FIG. 8 will position the mandrel 4 and drag assembly 8 into the same relative positions as described with reference to FIG. 6 above. The j-pin 34 stops travel in the j-slot 38 and the shear sub 18 is well away from the collet fingers 40, allowing the intervention tool 2 to move downhole.

Figure 8A:
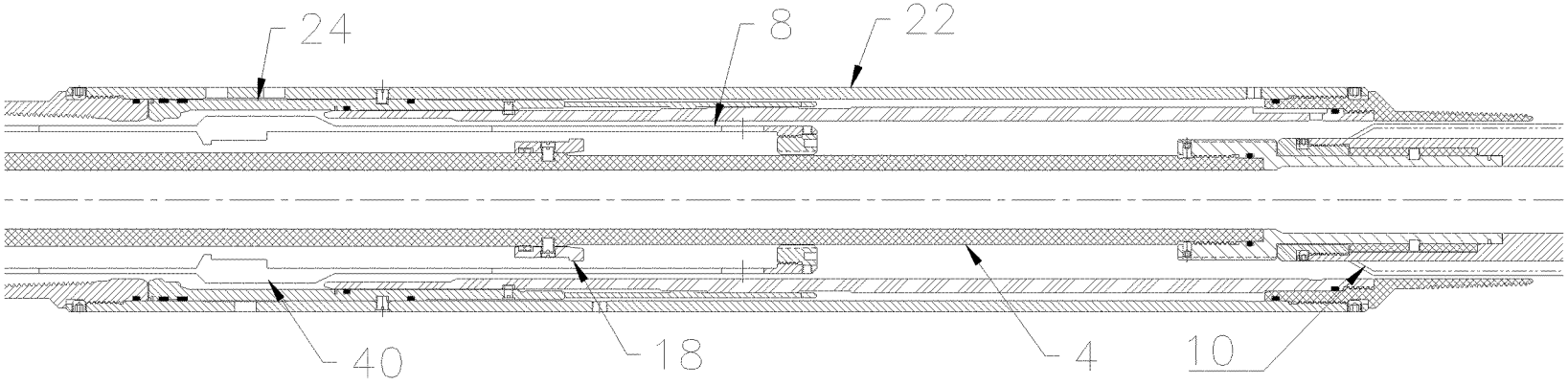
FIG. 8*a* is a cross sectional view of one embodiment of an intervention tool of the present invention in a downhole sleeve of the present invention, in which the collet is located in a profile of the downhole sleeve and the shear sub is distanced from the collet, to allow the collet to retract.
Figure 8B:
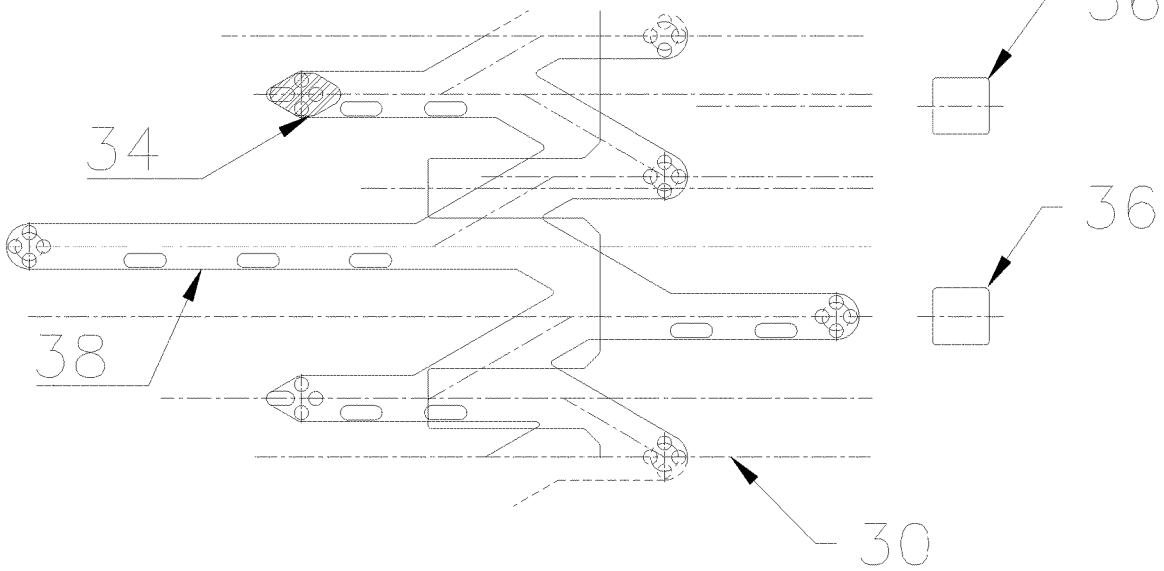
FIG. 8*b* is an elevation view of J-pin and J-slot positions the for configuration of FIG. 8*a;*

With reference to FIG. 8, the intervention tool 2 is pushed into compression, the j-pin 34 is in the compression short stroke of j-slot 38 and at a rotation to 230 degrees from the position of FIG. 3*c*, and the collet is in "soft collet" mode.

Figure 9A:
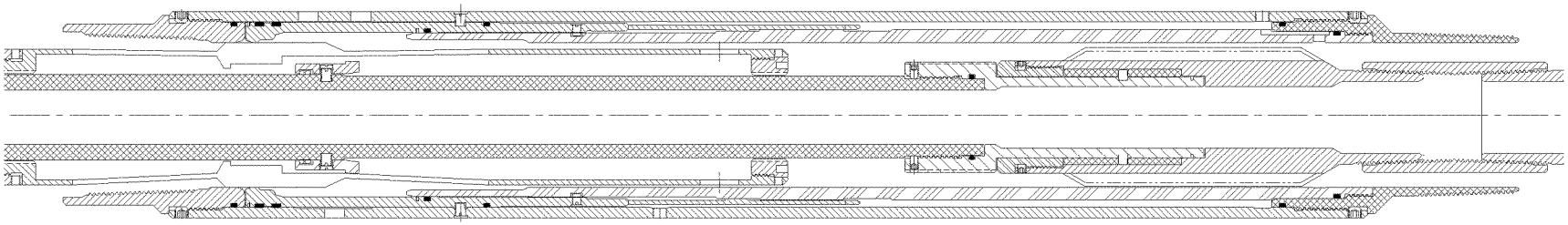
FIG. 9*a* is a cross sectional end view of one embodiment of the intervention tool of the present invention, being pulled out of a downhole sleeve of the present invention, with the collet in a soft mode in which the shear sub is disengaged from the collet, to allow the collet to retract.
Figure 9B:
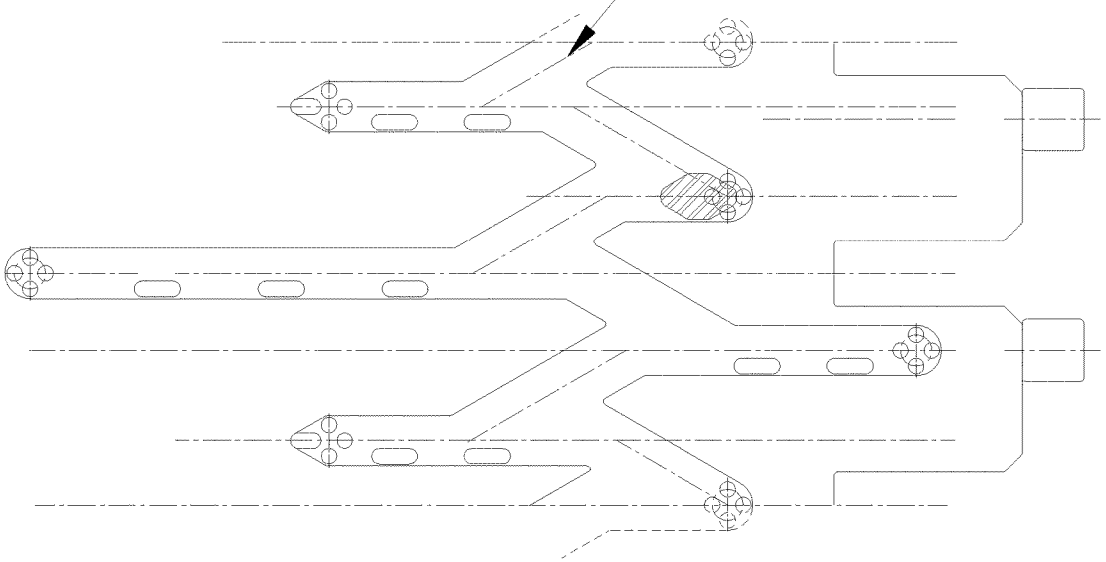
FIG. 9*b* is an elevation view of J-pin and J-slot positions for the configuration of FIG. 9*a.*

In FIG. 9, tension is pulled on the intervention tool 2 again without closing the downhole sleeve 22, the j-pin 34 is in the tension short stroke of the j-slot 38 at a rotation of 300 degrees from the position of FIG. 3*c* and the collet is in "soft collet" mode As the intervention tool 2 is pulled through a downhole sleeve, tension load values experienced on the locator mechanisms 10 can be used to determine if a downhole sleeve 22 is closed or open. The locator mechanism 10 experiences a first tension load value when passing a closed valve 24 and a second tension load value when passing an open valve 24. These tension load values are readable at the surface to provide an indication of the position of each downhole sleeve 22 as the intervention tool 2 is passed therethrough.

For all of the steps and positions for running in and setting of the intervention tool 2, each position is preferably set or guided by the J-pin and J-slot arrangement 30, that ensure that the intervention tool 2 stays in the desired position until a compression or tension forces it to move to the next J-pin/J-slot position.

In some cases, it is desirable to set the present intervention tool in a section of liner or casing either uphole or downhole from the downhole sleeve 22. Such arrangement is desirable when pressure testing the liner or casing string and/or the downhole sleeve above the other downhole sleeves that have already been opened, it is also useful when it is necessary to sand jet perforate between downhole tools. In such cases, the intervention tool 2 can be set and unset using the same steps as described above for setting or unsetting in a downhole sleeve 22.

In setting the present intervention tool 2 inside a blank section of liner or casing like a standard compression set packer, the collet 40 of the drag assembly 8 again act as a drag mechanism between the intervention tool 2 and the inner surface of the blank section of liner or casing, to allow relative movement of these two components for subsequent operations.

The multi-cycle sleeve 22 and mating intervention tool 2 of the present invention allow the system to run into a wellbore without the slips or packing element being set. It further allows the intervention tool 2 to engage the collet fingers 40 in a profile inside the downhole sleeve 22 by reciprocation of the intervention tool 2, after downhole sleeve opening, to mechanically close the downhole sleeve. The present intervention tool 2 can be cycled from a run in hole position to a pull out of hole position by reciprocation of the intervention tool 2 that allows the collet fingers 40 to be resiliently in soft mode for all of these positions.

The collet of the drag assembly acts to engage a profile in the downhole sleeve only in one position, namely after the downhole sleeve 22 has been hydraulically opened, such that a hard pulling force on downhole sleeve valve 24 serves to close it.

The previous description of the disclosed embodiments is provided to enable any person skilled in the art to make or use the present invention. Various modifications to those embodiments will be readily apparent to those skilled in the art, and the generic principles defined herein may be applied to other embodiments without departing from the spirit or scope of the invention. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are known or later come to be known to those of ordinary skill in the art are intended to be encompassed by the elements of the claims. Moreover, nothing disclosed herein is intended to be dedicated to the public regardless of whether such disclosure is explicitly recited in the claims.

The invention claimed is:

1. A downhole wellbore system comprising:

a. one or more downhole sleeves run on a liner; and b. an intervention tool deployable into the liner and into any one of said one or more downhole sleeves, said intervention tool comprising one or more slips, a packer and a collet, each of which being selectively engagable to an inner surface of the downhole sleeve, wherein the intervention tool is reciprocateable within the liner and one or more downhole sleeves between any one or more positions selected from the group consisting of: downhole sleeve opening position, downhole sleeve closing position, pull uphole position, push downhole position, and setting in a blank section of the liner position, wherein said intervention tool is reciprocateable to a downhole sleeve closing position in which the one or more slips are unset and the packer is unpacked from the inner surface of the downhole tool and the collet is engaged inner surface of the downhole sleeve, such that axial movement of the intervention tool manipulates the downhole sleeve to close it.

2. The system of claim 1, wherein the intervention tool is reciprocateable to a downhole sleeve opening position in which said the one or more slips are set against the inner surface of the downhole sleeve, the packer is packed against the inner surface of the downhole sleeve, and the downhole sleeve is openable by application of hydraulic pressure.

3. The system of claim 1, wherein the collet is engagable in a sleeve profile formed on the inner surface of the downhole sleeve.

4. The system of claim 3, wherein the collect is engagable in the sleeve profile of the inner surface of the downhole sleeve only in the downhole sleeve closing position.

5. The system of claim 1 wherein, the intervention tool is reciprocateable to the pull uphole position and push downhole position without opening or closing the downhole sleeve.

6. The system of claim 1, wherein the one or more slips, the packer and the collet are housed on a drag assembly of the intervention tool, and wherein the intervention tool further comprises a mandrel section at least partially radially surrounded by the drag assembly such that the drag assembly is slidably arranged over the mandrel.

7. The system of claim 6, wherein the mandrel is axially and rotatably moveable within the drag assembly.

8. The system of claim 7, wherein the collet comprises one or more radially resilient collet fingers around a circumference and below the drag assembly.

9. The system of claim 8, wherein the mandrel comprise a shear sub arranged around a circumference of the mandrel, said shear sub comprising a shear sub profile formed on an outer surface thereof, said shear sub profile selectively engageably with a collet finger profile formed on an inner surface of each collet finger.

10. The system of claim 9, wherein axial movement of the mandrel within the drag assembly serves to move the shear sub relative to the collet fingers to selectively engage and disengage the shear sub profile with the collet finger profiles to shift the collet fingers from a non-resilient, engaged mode to a resilient, unengaged mode.

11. The system of claim 10, wherein the collet fingers are shifted to the non-resilient, engaged mode only when the intervention tool is reciprocated to the sleeve closing position.

12. The system of claim 6, further comprising a J-pin and J-slot arrangement between the mandrel and the drag assembly for guiding movement of the mandrel relative to the drag assembly between said one or more intervention tool positions and for holding position until an axial force is applied to the mandrel.

13. The system of claim 12, wherein the J-pin and J-slot arrangement comprises one or more positions in which the collet fingers are in resilient mode and one position in which collet fingers are in non-resilient mode.

14. A method of manipulating an intervention tool in a liner comprising one or more downhole sleeves, said method comprising the steps of:

a. deploying an intervention tool into the liner and into any one of said one or more downhole sleeves, said intervention tool comprising one or more slips, a packer and a collet, each being selectively engagable to an inner surface of the downhole sleeve; and b. reciprocating the intervention tool between one or more positions selected from the group consisting of: downhole sleeve opening position, downhole sleeve closing position, pull uphole position, push downhole position, and setting in a blank section of the liner position, wherein reciprocating the intervention tool to the pull uphole position and push downhole position is performed without opening or closing the downhole sleeve.

15. The method of claim 14, wherein reciprocating the intervention tool to a downhole sleeve opening position comprises, setting said the one or more slips against the inner surface of the downhole sleeve, packing the packer against the inner surface of the downhole sleeve, and applying hydraulic pressure into the downhole sleeve to open.

16. The method of claim 14, wherein reciprocating the intervention tool to a downhole sleeve closing position comprises unsetting the one or more slips, unpacking the packer from the inner surface of the downhole tool, engaging the collet against the inner surface of the downhole sleeve and applying axial movement to the intervention tool to manipulate the downhole sleeve to close.

17. The method of claim 16, wherein engaging the collet against the inner surface of the downhole sleeve comprises engaging the collet in a sleeve profile formed on the inner surface of the downhole sleeve.

18. The method of claim 17, wherein engaging the collect in the sleeve profile of the inner surface of the downhole sleeve only occurs in the downhole sleeve closing position.

19. The method of claim 14, wherein the one or more slips, the packer and the collet are housed on a drag assembly of the intervention tool, and wherein the intervention tool further comprises a mandrel section at least partially radially surrounded by the drag assembly such that the drag assembly is slidably arranged over the mandrel.

20. The method of claim 19, wherein the collet comprises one or more radially resilient collet fingers around a circumference and below the drag assembly.

21. The method of claim 20, wherein the mandrel comprise a shear sub arranged around a circumference of the mandrel, said shear sub comprising a shear sub profile formed on an outer surface thereof, said shear sub profile selectively engageably with a collet finger profile formed on an inner surface of each collet finger.

22. The method of claim 21, further comprising axially moving the mandrel within the drag assembly to move the shear sub relative to the collet fingers to selectively engage and disengage the shear sub profile with the collet finger profiles to shift the collet fingers from a non-resilient, engaged mode to a resilient, unengaged mode.

23. The method of claim 22, further comprising shifting the collet fingers to the non-resilient, engaged mode only when reciprocating the intervention tool to the sleeve closing position.

24. The method of claim 23, further comprising guiding movement of the mandrel relative to the drag assembly between said one or more intervention tool positions by means of a J-pin and J-slot arrangement between the mandrel and the drag assembly, and holding position until an axial force is applied to the mandrel.

25. The method of claim 24, wherein the J-pin and J-slot arrangement comprises one or more positions in which the collet fingers are in resilient mode and one position in which collet fingers are in non-resilient mode.

* * * * *